US012638279B1

(12) United States Patent
Ramey

(10) Patent No.: US 12,638,279 B1
(45) Date of Patent: May 26, 2026

(54) PROJECTILE WITH A TAPERED STRUCTURE WITHIN A FORWARD CAVITY

(71) Applicant: Liberty Opco, LLC, Bradenton, FL (US)

(72) Inventor: Gary Williams Ramey, Gainesvlille, GA (US)

(73) Assignee: Liberty OPCO, LLC, Bradenton, FL (US)

( * ) Notice: Subject to any disclaimer, the term of this patent is extended or adjusted under 35 U.S.C. 154(b) by 217 days.

(21) Appl. No.: 18/767,307

(22) Filed: Jul. 9, 2024

Related U.S. Application Data

(60) Provisional application No. 63/526,465, filed on Jul. 13, 2023.

(51) Int. Cl.
*F42B 10/46* (2006.01)
*F42B 10/42* (2006.01)

(52) U.S. Cl.
CPC ..... *F42B 10/42* (2013.01)

(58) Field of Classification Search
CPC ..... F42B 10/64; F42B 10/04; F42B 10/14; F42B 10/54; F42B 10/26; F42B 10/42; F42B 14/061; F42B 15/01
USPC ..... 102/501; 244/3.1, 3.23, 3.15, 3.24
See application file for complete search history.

(56) References Cited

U.S. PATENT DOCUMENTS 2,324,346 A * 7/1943 Albree ..... F42B 10/42 244/3.1
4,471,699 A * 9/1984 Turco ..... F42B 7/10 102/501
5,097,767 A * 3/1992 Cirillo ..... F42B 10/46 102/517
5,116,224 A * 5/1992 Kelsey, Jr. ..... F42B 10/22 102/501
5,622,335 A * 4/1997 Trouillot ..... F42B 10/06 102/385
5,841,058 A * 11/1998 Manis ..... F41A 21/00 42/76.01
6,973,879 B1 * 12/2005 McElroy ..... F42B 12/76 102/501
6,978,967 B1 * 12/2005 Scheper ..... F42B 10/16 102/385
8,434,410 B2 * 5/2013 AlSalem ..... F42B 12/34 102/517
11,712,637 B1 * 8/2023 Hoffberg ..... A63H 33/18 701/2
12,181,263 B2 * 12/2024 Walker ..... F42B 7/12
(Continued)

*Primary Examiner* — Michael D David
(74) *Attorney, Agent, or Firm* — Anton J. Hopen; Trenam Law

(57) ABSTRACT

A projectile comprising a bullet slidably mounted within a cartridge, which includes a propellant to propel the bullet when fired. The bullet features a head section and a trailing section located aft of the head section. The head section comprises one or more side walls defining a cavity with an opening at the leading end of the bullet. A tapered structure secured to the trailing section extends into the cavity, tapering in a fore direction towards the central longitudinal axis of the bullet. Upon impact with a target, the one or more side walls are configured to break away from the trailing section, and the tapered structure reduces drag and pressure build-up in the trailing section, allowing for greater penetration capabilities.

20 Claims, 6 Drawing Sheets

(56) References Cited

U.S. PATENT DOCUMENTS

| | | | | |
|---|---|---|---|---|
| 2011/0297031 | A1* | 12/2011 | Fu | F42B 10/06 244/3.24 |
| 2013/0092041 | A1* | 4/2013 | Seecamp | F42B 30/02 102/501 |
| 2015/0308797 | A1* | 10/2015 | Smith | F42B 5/067 102/464 |
| 2017/0045319 | A1* | 2/2017 | Ramey | F41C 23/10 |
| 2017/0322002 | A1* | 11/2017 | Mahnke | F42B 12/02 |
| 2020/0300590 | A1* | 9/2020 | Choiniere | F42B 10/20 |
| 2021/0396502 | A1* | 12/2021 | Roberson | F42C 19/0807 |
| 2023/0243629 | A1* | 8/2023 | Polovnev | F42B 10/46 244/3.24 |
| 2024/0003659 | A1* | 1/2024 | Rushforth | F41F 3/10 |
| 2024/0175666 | A1* | 5/2024 | Barrett | F42B 14/06 |

* cited by examiner

PROJECTILE WITH A TAPERED STRUCTURE WITHIN A FORWARD CAVITY

CROSS-REFERENCE TO RELATED APPLICATIONS

This nonprovisional application claims priority to provisional application No. 63/526,465, entitled "Projectile Having a Spear Structure Within a Forward Cavity," filed Jul. 13, 2023 by the same inventor(s).

BACKGROUND OF THE INVENTION

Field of the Invention

This invention relates, generally, to the art of projectiles. More particularly, it relates to a projectile having a tapered, spear-like structure within a forward hollow cavity.

Description of the Prior Art

Firearms and ammunition have undergone significant advancements over the years, leading to the development of various types of bullets designed to enhance performance and achieve specific outcomes upon impact. For example, the hollow point bullet has become widely used in both law enforcement and self-defense applications due to its unique ability to deform upon impact, thereby maximizing stopping power while minimizing the risk of over-penetration.

A hollow point bullet is characterized by a cavity in its nose, which is designed to cause the bullet to expand upon striking a target. This expansion increases the diameter of the bullet as it passes through tissue, creating a larger wound channel compared to traditional full metal jacket (FMJ) bullets. The deformation process, known as mushrooming, enhances the bullet's ability to transfer energy to the target effectively, resulting in greater stopping power and reducing the likelihood of the bullet exiting the target and potentially causing collateral damage.

Upon impact, the hollow point bullet's cavity begins to collapse as the bullet encounters resistance from the target material. The pressure exerted on the cavity walls forces the walls of the bullet to expand radially, forming a mushroom-like shape. This deformation process is influenced by several factors, including the bullet's design, velocity, and the physical properties of the target. The controlled expansion is intended to achieve tissue disruption while maintaining sufficient penetration to reach vital organs, thereby incapacitating the target more effectively.

The design of hollow point bullets has evolved to improve their performance and reliability. Modern hollow point bullets often feature enhancements such as pre-scored jacket sections, which promote uniform expansion, and bonded core designs, which prevent jacket-core separation during deformation. These advancements ensure consistent performance across various impact velocities and target materials, making hollow point bullets a preferred choice for critical applications.

Hollow-point projectiles were designed to mushroom on impact without the walls separating from the core. This intended functionality, however, reduces the forward travel after impact. Thus, there is a need for a projectile configured to expand outwardly upon impact while maintaining greater forward travel in comparison to current hollow-point projectiles.

In view of the art considered as a whole at the time the present invention was made, it was not obvious to those of ordinary skill in the art how such a projectile could be provided.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The present invention is directed to a projectile comprising a bullet that can be slidably mounted within a cartridge, which includes a propellant to propel the bullet when fired. The bullet features a head section and a trailing section located aft of the head section. The head section comprises one or more side walls defining a cavity with an opening at the leading end of the bullet. A tapered structure is secured to the trailing section and extends into the cavity, tapering in a fore direction towards the central longitudinal axis of the bullet. The tapered structure is designed to direct soft tissue and fluids to the weak point of the cavity walls. The one or more side walls are configured to break away from the trailing section upon impact with a target. In addition, the tapered structure is designed to reduce drag and pressure build-up in the trailing section of the bullet after the side walls have broken away, allowing for greater penetration capabilities.

In some embodiments, the cavity has a depth between approximately 0.296 inches and 0.355 inches, and the opening has a diameter between approximately 0.2 inches and 0.272 inches. The one or more side walls may have a sufficient thickness to ensure breakage from the trailing section and may be made of copper or another brittle material to ensure breakage rather than deformation. The side walls may have a uniform thickness between their fore and aft ends, ensuring that the weakest point is at the aft end where they connect to the trailing section. Additionally, the side walls can be constructed by drilling out the core of the leading end of the bullet to establish a cylindrical opening and then forcing them inward towards the central longitudinal axis to create an arcuate profile shape. In some embodiments, the bullet may include one or more annular recesses or grooves extending generally around its circumference to create a weak point. These recesses extend inwardly towards the central longitudinal axis of the bullet and are generally located at or near the aft end of the side walls where they meet the trailing section, establishing the breaking point upon impact.

The tapered structure can have various dimensions to alter the penetration depth and speed of the bullet. In some embodiments, the tapered structure's length is between approximately 0.20 inches and 0.275 inches and/or approximately 40-50% of the length of the bullet. The width of the base of the tapered structure may be between approximately 0.148 inches and 0.202 inches and/or generally between 25% and 50% of the bullet width. Moreover, the width of the tapered structure can vary relative to the cavity and bullet width, with some embodiments having a width generally between 30% and 75% of the cavity width. In some embodiments, the tapered structure has a predetermined slope between its leading end and its base to direct material entering the cavity towards the aft end of the side walls, increasing pressure at this location to cause the side walls to break away from the trailing section.

The trailing section also includes a generally forward-facing surface surrounding the base of the tapered structure. This forward-facing surface can be perpendicular to the central longitudinal axis of the bullet or have a tapered or convex shape. Additionally, in some embodiments, the length of the trailing section, not including the tapered structure, is less than 50% of the bullet length.

In some embodiments, the bullet may further include a drive chamfer. The drive chamfer may be in the form of an annular raised ridge formed around the trailing section, extending outwardly in a lateral direction to enhance the interaction between the bullet and the cartridge, as well as the firearm barrel. This drive chamfer improves sealing, stability, and gas management while reducing barrel wear.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF EMBODIMENTS

Figure 1:
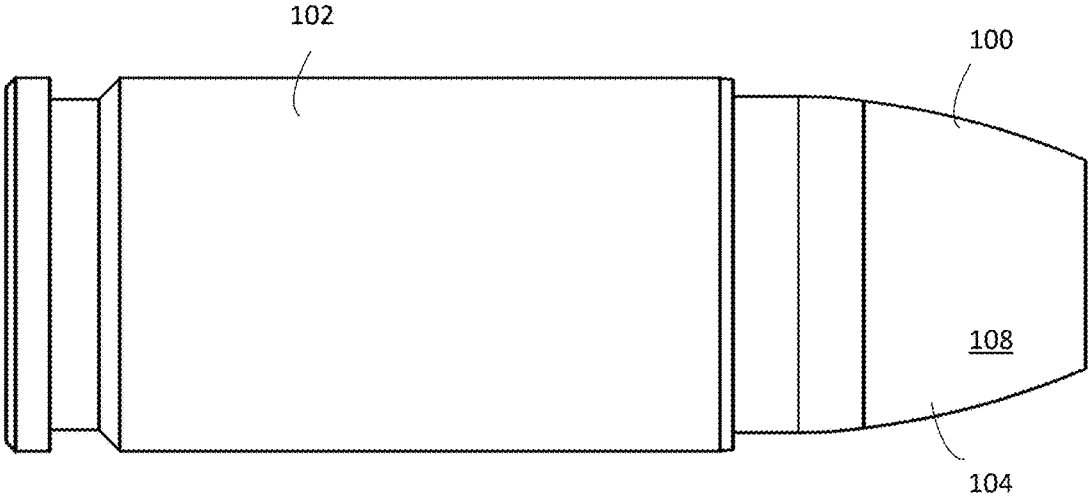
FIG. 1 is a side view of an embodiment of the projectile.
Figure 2:
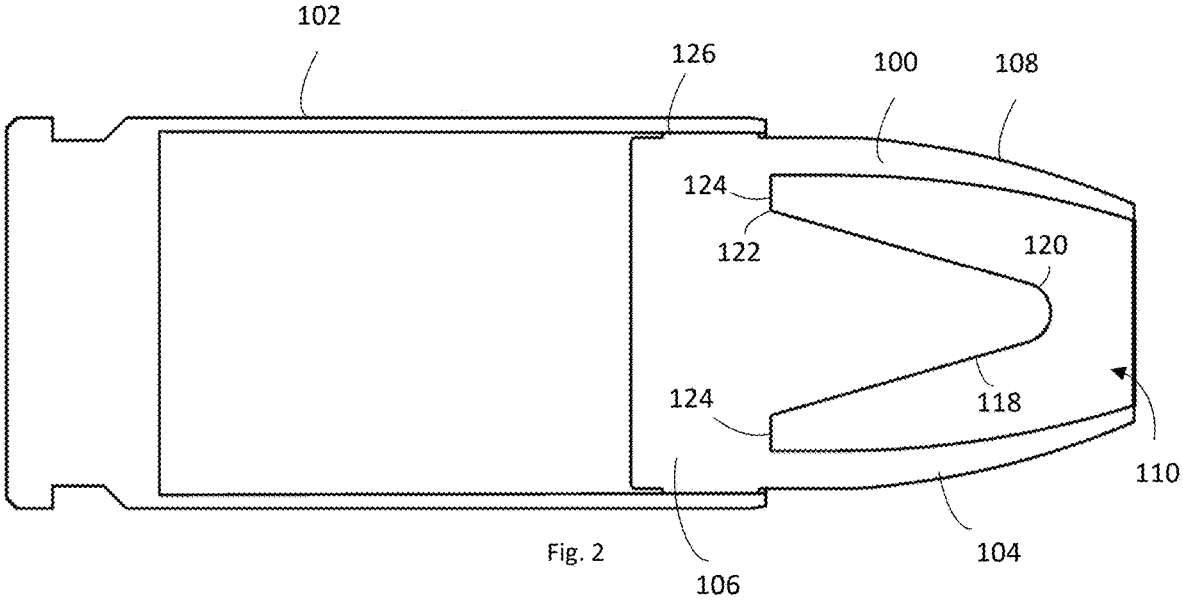
FIG. 2 is a cross-sectional view of an embodiment of the projectile.
Figure 3:
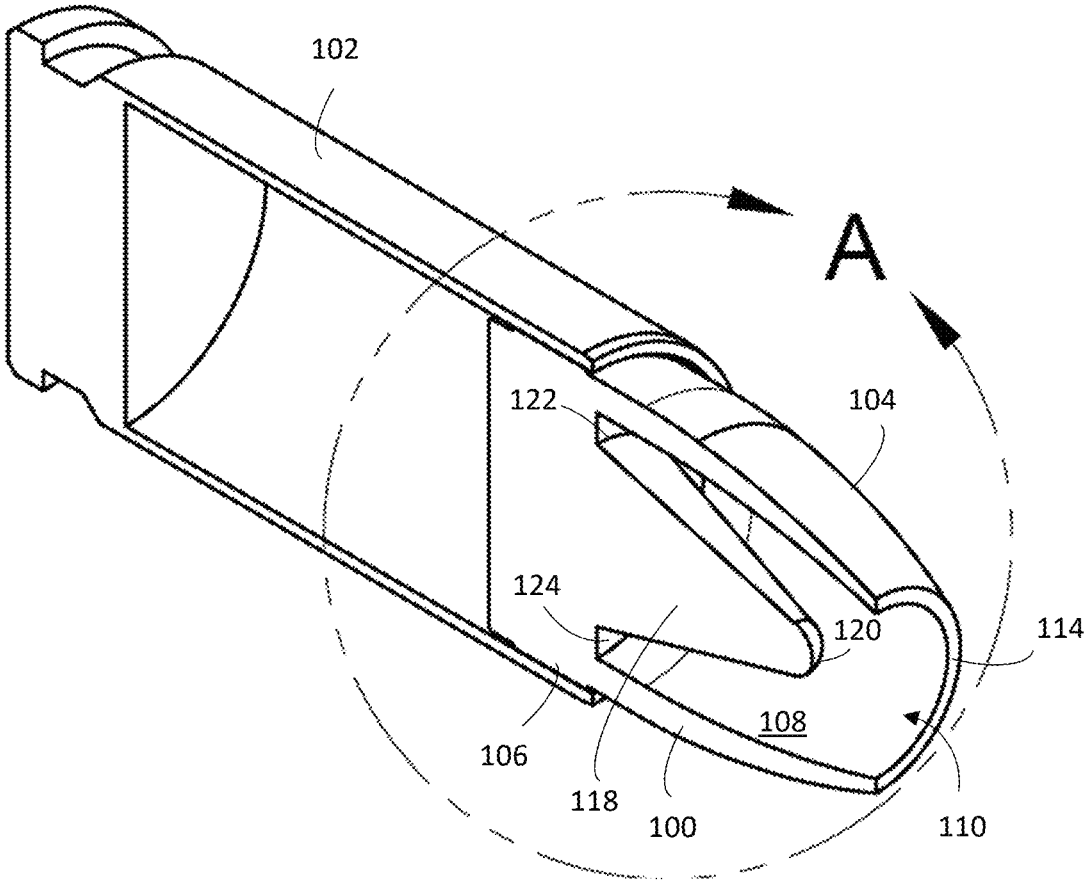
FIG. 3 is a cross-sectional perspective view of an embodiment of the projectile.
Figure 4:
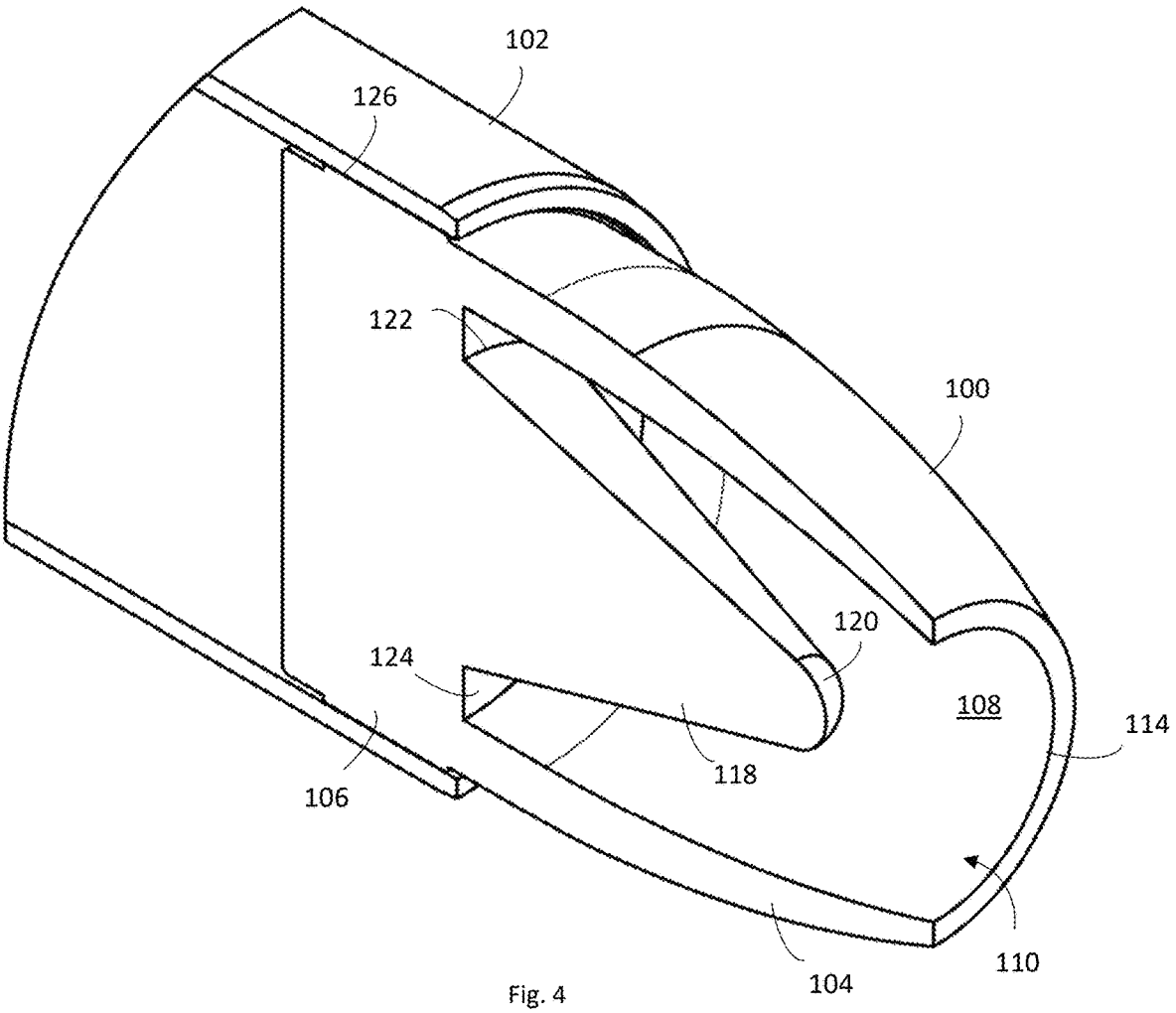
FIG. 4 is a close-up, cross-sectional view of the detail A from FIG. 3.

In the following detailed description of the preferred embodiments, reference is made to the accompanying drawings, which form a part thereof, and within which are shown by way of illustration specific embodiments by which the invention may be practiced. It is to be understood that other embodiments may be utilized, and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

The phrases "in some embodiments," "according to some embodiments," "in the embodiments shown," "in other embodiments," and the like generally mean the particular feature, structure, or characteristic following the phrase is included in at least one implementation. In addition, such phrases do not necessarily refer to the same embodiments or different embodiments.

All numerical designations, such as measurements, efficacies, physical characteristics, forces, and other designations, including ranges, are approximations which are varied up or down by increments of 1.0 or 0.1, as appropriate. It is to be understood, even if it is not always explicitly stated that all numerical designations are preceded by the term "about." As used herein, "about" or "approximately" refers to being within an acceptable error range for the particular value as determined by one of ordinary skill in the art, which will depend in part on how the value is measured or determined. As used herein, the term "about" refers to +10% of the numerical; it should be understood that a numerical including an associated range with a lower boundary of greater than zero must be a non-zero numerical, and the term "about" should be understood to include only non-zero values in such scenarios.

The present invention includes a projectile having a hollow point bullet with a material dispersion structure (such as a tapered or pointed structure) residing within the hollow cavity. Upon firing, the bullet exits the cartridge and travels to its intended target. Upon impact with the target, the pressure builds within the hollow cavity causing the side wall(s) of the cavity to expand laterally, and break away from the trailing end of the bullet to which the tapered structure is secured. The tapered structure is configured to allow for greater penetration capabilities by reducing the drag and pressure build up in the trailing end of the bullet on account of its tapered or conical shape.

Referring now to the figures, as exemplified in FIGS. 1-4, the projectile includes a bullet 100 that is slidably mounted within a cartridge 102. The part of the cartridge 102 that is not occupied by the bullet 100 is filled with a propellant to propel the bullet 100 when fired. The propellant may be any of those known in the field, including but not limited to gun powder, cordite, and ballistite.

The bullet 100 is comprised of a hollow head section 104 and a trailing section 106 located aft of the head section 104. The head section 104 includes a cavity 110 established by one or more side walls 112. Side wall(s) 112 extend generally about the circumference of the head section 104. A single side wall 112 can extend about the circumference of the head section 104, or the side wall 112 can be comprised of segmented sections configured to separate from each other about one or more perforations or scoring lines extending generally in a lengthwise direction of the bullet 100.

The hollow cavity 110 of the present invention is larger than cavities typically found in hollow point bullets. A larger hollow cavity 110 reduces the weight of the bullet 100, which leads to faster travel speeds, greater kinetic energy transfer, and allows an operator to carry more bullets per pound in comparison to traditional hollow point bullets. In some embodiments, the cavity depth is between approximately 0.296 inches to approximately 0.355 inches and/or the opening 114 to the hollow cavity 110 has a diameter between approximately 0.2 inches and approximately 0.272 inches.

As will be explained in greater detail below, the side wall(s) 112 are configured to break away from the trailing section 106. In some embodiments, the side wall(s) 112 have a thickness of around 0.037 inches at least at the aft end the side wall(s) 112 to ensure that the side wall(s) 112 separate from the trailing section 106. The side wall(s) 112 may also be comprised of copper or another brittle material rather than lead to ensure that the side wall(s) 112 break away from the trailing section 106 rather than deforming and remaining attached to the trailing section 106.

Figure 6:
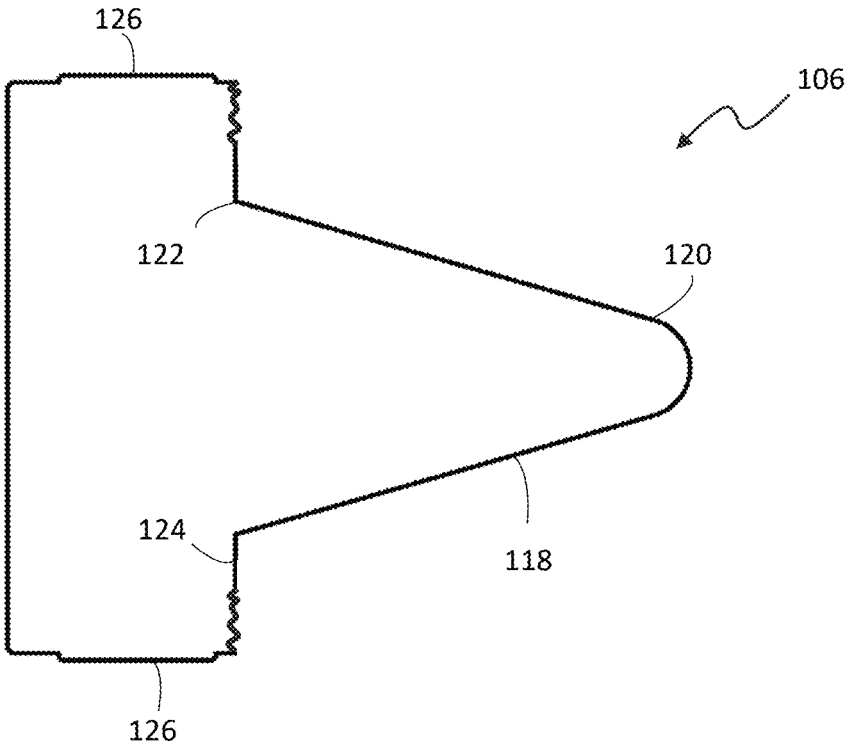
FIG. 6 is a side view of the bullet portion of an embodiment of the present invention after the side wall(s) break away from the bullet.

In some embodiments, the side wall(s) 112 have a uniform thickness between the fore and aft ends of the side wall(s) 112. Uniform thickness of the side wall(s) 112 ensures that the weakest point of the side walls 112 is located at the aft end of the side wall(s) 112 where the side wall(s) 112 connect to the trailing section 106 of the bullet 100. The uniform thickness helps to cause the side wall(s) 112 to splay out and/or break away at the aft end of the side wall(s) 112 and allow the trailing section 106 as shown in FIG. 6 to maintain greater kinetic energy and continue traveling further along its path of travel in comparison to typical hollow point bullets.

In some embodiments, the uniformly thick side wall(s) 112 are constructed by drilling out the core of the leading end of the bullet 100 to establish a cylindrical opening. The side wall(s) 112 are then forced inward towards the central longitudinal axis of the bullet 100 to create an arcuate profile shape shown in FIGS. 1-4 and a circular opening 114 with a diameter between approximately 0.2 inches and approximately 0.272 inches.

Figure 7:
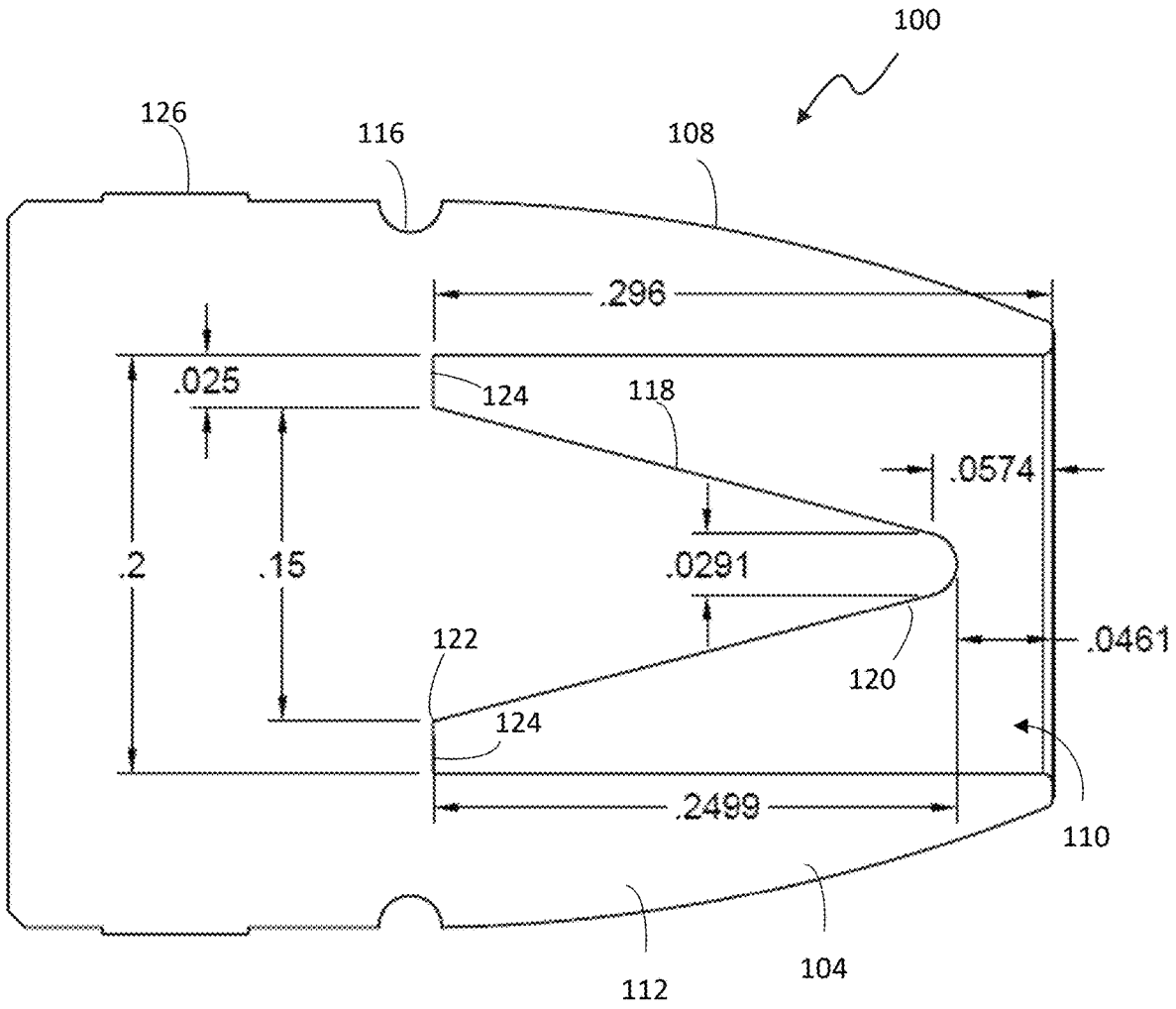
FIG. 7 is a cross-sectional view of an embodiment of the bullet displaying exemplary dimensions.
Figure 8:
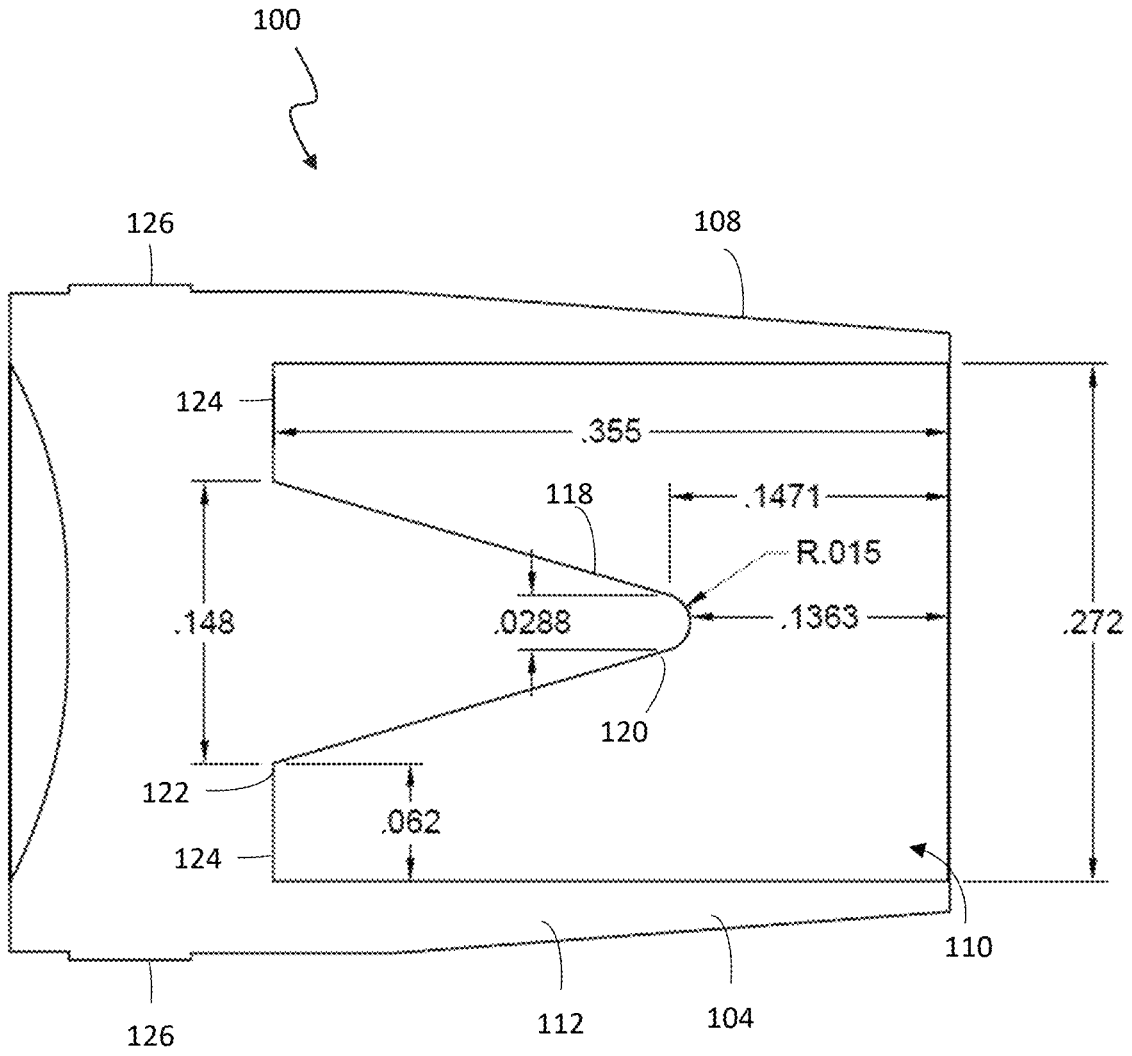
FIG. 8 is a cross-sectional view of an embodiment of the bullet displaying exemplary dimensions.

As exemplified in FIG. 7, some embodiments of the bullet 100 include an annular recess/groove 116 or a series of recesses/grooves that extend generally around the circumference of the bullet 100. The one or more recesses 116 extend inwardly towards the central longitudinal axis of the bullet 100 to create a weak point. The recess 116 may be in the form of a semi-circular groove, a scoring line, or another inwardly extending shape to reduce the cross-sectional material of the bullet 100.

The recesses 116 are also located generally at or near the aft end of the side wall(s) 112 where the side wall(s) 112 meet the trailing section 106 of the bullet 100. When the hollow cavity 110 becomes pressurized upon impact, the recesses 116 establish the breaking point for the side wall(s) 112 thereby allowing the side wall(s) 112 to splay outwardly and break away from the trailing section 106 of the bullet 100 as illustrated in FIG. 6.

As previously noted, the bullet 100 also includes a material dispersion structure 118. As illustrated in the provided figures, the material dispersion structure is depicted as a tapered structure 118 that extends from trailing section 106 of the bullet 100. The tapered structure 118 projects towards the leading end of the bullet 100 and into the cavity 110. In some embodiments, the tapered structure 118 is conical. In some embodiments, the tapered structure 118 is pyramidal. The tapered structure 118 may be other shapes configured to disperse material into the side wall(s) and/or decrease the drag and pressure on the trailing section 106 of the bullet 100 thereby allowing the trailing section 106 of the bullet 100 to penetrate further and faster than if the bullet 100 lacked the tapered structure 118.

The dimensions of the tapered structure 118 can be adjusted to alter the penetration depth and speed of the bullet. For example, a shorter and narrower tapered structure 118 reduces the weight of the bullet 100 and the trailing section 106 of the bullet 100, thereby allowing the bullet 100 to travel faster. In some embodiments, the length of the tapered structure 118 is between approximately 0.20 inches and approximately 0.275 inches. In some embodiments, the tapered structure 118 has a length that is approximately 40-50% of the length of the bullet 100. In some embodiments, the tapered structure 118 has a length that is approximately 60% to approximately 80% of the length of the cavity 110. In some embodiments, the tapered structure 118 has a length that is approximately equal to or less than the length of the cavity 110. When the length of the tapered structure 118 is less than the length of the cavity 110, the side wall(s) 112 impact the target first to weaken the surface of the target and preserve the tip of the tapered structure 118, which ultimately leads to greater penetration depths.

Bullet 100 may further include a predetermined slope between the leading end 120 and the base 122 of the tapered structure 118 to direct material entering the cavity 110 towards the aft end of side wall(s) 112 thereby increasing pressure at said location to cause the side wall(s) 112 to break away from the trailing section 106 of the bullet 100 as illustrated in FIG. 6. The predetermined slope may be between approximately 0.284 and approximately 0.568. In some embodiments, the slope is between approximately 0.284 and approximately 1.03.

The width of the tapered structure 118 relative to the bullet 100 can also vary to produce different performance metrics. In some embodiments, the width of the base of the tapered structure 118 is between approximately 0.148 inches and approximately 0.202 inches. In addition, In some embodiments, the width of the tapered structure 118 is generally between approximately 25% and approximately 50% of the bullet width. In some embodiments, the tapered structure 118 has a base width that is between approximately 40% and approximately 60% of the width of the bullet 100.

In some embodiments, the width of the base of the tapered structure 118 is less than the width of the cavity 110 at the aft end of the side wall(s) 112 resulting in a generally flat or minimally tapered surface 124 surrounding the base of the tapered structure 118. The tapered surface of structure 118 and the flat surface 124 work in conjunction to direct material entering the cavity 110 towards the aft ends of the side wall(s) 112 to increase the pressure at said points and break the side wall(s) 112 from the trailing section 106 of the bullet 100. In some embodiments, flat surface 124 has a radial expanse between the tapered structure 118 and the internal surface of the side wall(s) 112 that is between approximately 0.025 inches and approximately 0.062 inches. In some embodiments, the width of the tapered structure 118 is generally between approximately 30% and approximately 75% of the cavity width and thus the width of surface 124 is between approximately 70% and approximately 25% of the cavity width. In some embodiments, the width of the tapered structure 118 is generally between approximately 50% and approximately 75% of the cavity width and thus the width of surface 124 is between approximately 50% and approximately 25% of the cavity width.

As noted in the previous paragraph, some embodiments of the trailing section 106 of the bullet 100 have a tapered or convex-shaped surface 124. When the side wall(s) 112 break away from the trailing section 106 of the bullet 100, the tapered or convex-shaped surface 124 provides greater aerodynamics than a flat or concave leading end, leading to faster travel and further penetration. However, the slope of the taper of surface 124 is not equal to and is substantially distinct from the slope of the tapered structure 118.

As shown in FIG. 6, the trailing section 106 is intended to continue on its path of travel after the side wall(s) 112 break away from the trailing section 106. Thus, the length of the trailing section 106 of the bullet 100 can vary to produce different performance metrics. In some embodiments, the length of the trailing section 106 of the bullet 100 (the length between the aft end of the bullet and the start of the hollow cavity 110 or the aft end of the side wall(s)) is less than approximately 50% of the bullet length. In some embodiments, the trailing section 106 of the bullet 100 is less than approximately 30% of the bullet length.

Figure 5:
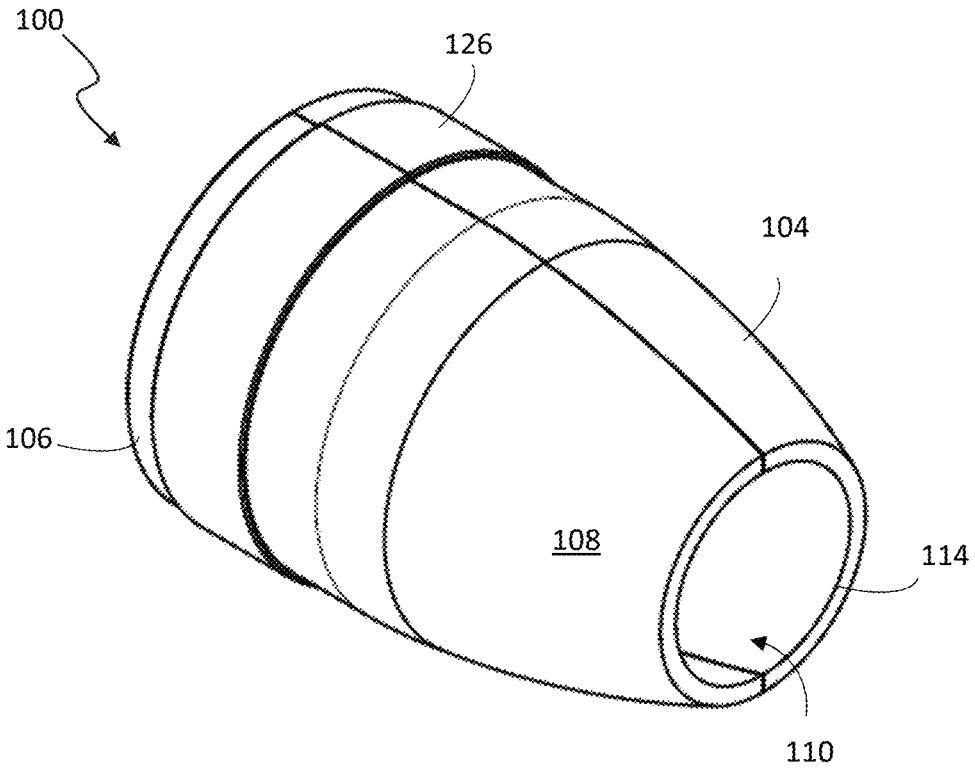
FIG. 5 is a perspective view of the bullet portion of an embodiment of the present invention.

As best depicted in FIG. 5, the outer surface of some embodiments of the bullet 100 includes a drive chamfer in the form of an annular raised ridge 126 formed around the trailing section 106 of the bullet 100. The annular ridge 126 extends outwardly in a lateral direction to contact the inner surface of the cartridge 102. In addition, the annular ridge 126 is in an aft location relative to the hollow cavity 110 and aft of any recessed breakpoints 116 in the bullet 100. The drive chamfer is designed to enhance the interaction between the bullet 100 and the cartridge 102 and the firearm barrel. In addition, the drive chamfer improves sealing, stability, and gas management, while also reducing barrel wear.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all the generic and specific features of the invention herein described, and all statements of the scope of the invention that, as a matter of language, might be said to fall therebetween.

What is claimed is:

1. A projectile comprising:

a bullet slidably mounted within a cartridge, the cartridge having a propellant, wherein the bullet includes a head section and a trailing section located aft of the head section;

the head section comprising one or more side walls defining a cavity and an opening in a leading end of the bullet leading to the cavity;

a tapered structure secured to the trailing section and extending into the cavity, wherein the tapered structure tapers in a fore direction towards a central longitudinal axis of the bullet;

wherein the one or more side walls are configured to break away from the trailing section after impact with a target;

wherein the tapered structure is configured to reduce drag and pressure build-up in the trailing section of the bullet after the one or more side walls have broken away from the bullet, allowing for greater penetration capabilities.

2. The projectile of claim 1, wherein the hollow cavity has a depth between approximately 0.296 inches and approximately 0.355 inches and the opening has a diameter between approximately 0.2 inches and approximately 0.272 inches.

3. The projectile of claim 1, wherein the one or more side walls have a sufficient thickness to ensure that the one more side walls will break away from the trailing section after impact with the target.

4. The projectile of claim 1, wherein the one or more side walls are comprised of copper to ensure breakage from the trailing section rather than deformation.

5. The projectile of claim 1, wherein the one or more side walls have a uniform thickness between a fore end and an aft end of the one or more side walls, thereby ensuring that the one or more side walls break away from the trailing section where the one or more side walls connect to the trailing section.

6. The projectile of claim 1, wherein the one or more side walls are constructed by drilling out the core of the leading end of the bullet to establish a cylindrical opening, and then forcing the side walls inward towards the central longitudinal axis to create an arcuate profile shape.

7. The projectile of claim 1, further comprising one or more annular recesses or grooves extending generally around the circumference of the bullet to create a weak point, wherein the recesses extend inwardly towards the central longitudinal axis of the bullet.

8. The projectile of claim 7, wherein the recesses are located generally at or near the aft end of the one or more side walls where the one or more side walls meet the trailing section, establishing the breaking point for the one or more side walls upon impact.

9. The projectile of claim 1, wherein a length of the tapered structure is between approximately 0.20 inches and approximately 0.275 inches.

10. The projectile of claim 1, wherein a length of the tapered structure is approximately 40-50% of a length of the bullet.

11. The projectile of claim 1, wherein a width of a base of the tapered structure is between approximately 0.148 inches and approximately 0.202 inches.

12. The projectile of claim 1, wherein the tapered structure has a slope between a leading end and a base of the tapered structure to direct material entering the cavity towards the aft end of the one or more side walls to increase pressure at said location to cause the one or more side walls to break away from the trailing section.

13. The projectile of claim 1, wherein a width of a base of the tapered structure is generally between 25% and 50% of a width of the bullet.

14. The projectile of claim 1, wherein a width of a base of the tapered structure is generally between 30% and 75% of a width of the cavity and the trailing section includes a generally forward-facing surface surrounding the base of the tapered structure.

15. The projectile of claim 1, wherein the forward-facing surface surrounding the base of the tapered structure is perpendicular to the central longitudinal axis of the bullet.

16. The projectile of claim 1, wherein the forward-facing surface surrounding the base of the tapered structure is a tapered or convex-shaped surface.

17. The projectile of claim 1, wherein a length of the trailing section not including the tapered structure is less than 50% of a length of the bullet.

18. The projectile of claim 1, further comprising a drive chamfer in the form of an annular raised ridge formed around the trailing section of the bullet, the annular ridge extending outwardly in a lateral direction.

19. A projectile comprising:

a copper bullet slidably mounted within a cartridge, the cartridge having a propellant, wherein the bullet includes a head section and a trailing section located aft of the head section;

the head section comprising one or more side walls defining a cavity and an opening in a leading end of the bullet leading to the cavity;

a tapered structure secured to the trailing section and extending into the cavity, wherein the tapered structure tapers in a fore direction towards a central longitudinal axis of the bullet;

wherein the one or more side walls are configured to break away from the trailing section after impact with a target;

wherein the tapered structure is configured to reduce drag and pressure build-up in the trailing section of the bullet after the one or more side walls have broken away from the bullet, allowing for greater penetration capabilities.

20. A projectile comprising:

a copper bullet slidably mounted within a cartridge, the cartridge having a propellant, wherein the bullet includes a head section and a trailing section located aft of the head section;

the head section comprising one or more side walls defining a cavity and an opening in a leading end of the bullet leading to the cavity;

a tapered structure secured to the trailing section and extending into the cavity, wherein the tapered structure tapers in a fore direction towards a central longitudinal axis of the bullet;

wherein a width of a base of the tapered structure is less than a width of the cavity, thereby establishing a generally forward-facing surface on the trailing section that surrounds the base of the tapered structure, wherein the forward-facing surface is generally perpendicular to the central longitudinal axis of the bullet;

wherein the one or more side walls are configured to break away from the trailing section after impact with a target;

wherein the tapered structure is configured to reduce drag and pressure build-up in the trailing section of the bullet after the one or more side walls have broken away from the bullet, allowing for greater penetration capabilities.

* * * * *